US005933897A

United States Patent [19]

MacDonald

[11] Patent Number: 5,933,897

[45] Date of Patent: Aug. 10, 1999

[54] METHOD OF FORMING WATERPROOF STITCHED CONNECTIONS DURING SHOE MANUFACTURE

[76] Inventor: Bruce MacDonald, P.O. Box 511, Skowhegan, Me. 04976

[21] Appl. No.: 09/035,986

[22] Filed: Mar. 6, 1998

[51] Int. Cl.[6] ..... A43D 9/00; A43B 13/22

[52] U.S. Cl. ..... 12/142 R; 12/146 L; 12/142 MC; 36/98; 156/93

[58] Field of Search ..... 36/445, 46.5, 84, 36/14, 98, 4; 12/42 R, 142 E, 142 G, 142 MO, 145, 146 C, 146 L

[56] References Cited

U.S. PATENT DOCUMENTS

| | | | |
|---|---|---|---|
| 1,290,692 | 1/1919 | Ames | 12/142 E |
| 1,784,523 | 12/1930 | Hopkinson | 12/142 E |
| 2,133,346 | 10/1938 | Diller et al. | 12/146 C |
| 3,414,923 | 12/1968 | Rosen | 12/142 R |
| 3,698,027 | 10/1972 | Schwab et al. | 12/142 R |
| 4,023,238 | 5/1977 | Pfander | 12/142 MC |
| 4,508,582 | 4/1985 | Fink | 36/45 |
| 4,707,874 | 11/1987 | Champagne | 12/142 E |
| 5,253,434 | 10/1993 | Curley, Jr. et al. | 36/55 |
| 5,285,546 | 2/1994 | Haimerl | 12/142 E |
| 5,664,343 | 9/1997 | Byrne | 36/55 |
| 5,732,429 | 3/1998 | Strickland | 12/142 D |

FOREIGN PATENT DOCUMENTS

| | | | |
|---|---|---|---|
| 404309302 | 10/1992 | Japan | 12/146 C |
| 405285002 | 11/1993 | Japan | 12/146 C |

*Primary Examiner*—Paul T. Sewell
*Assistant Examiner*—J. Mohandesi
*Attorney, Agent, or Firm*—Frederick R. Cantor, Esq.

[57] ABSTRACT

A stitched waterproof joint can be formed between the vamp and top plug of a shoe by applying waterproof coatings to the interior facing surfaces of the vamp and plug, stitching the vamp and plug together to merge the waterproof coatings, heating the vamp and plug to eliminate voids in the merged film, and applying an additional waterproofing layer to the interior edge of the stitched joint between the vamp and the plug.

11 Claims, 2 Drawing Sheets

METHOD OF FORMING WATERPROOF STITCHED CONNECTIONS DURING SHOE MANUFACTURE

BACKGROUND OF THE PRESENT INVENTION

SUMMARY OF THE PRESENT INVENTION

In the manufacture of certain types of shoes a vamp panel is stitched to a top plug panel to form the major portion of the shoe upper. Typically the stitching operation is carried out along the toe and side edges of the plug panel. The present invention is concerned with a method of connecting the plug and vamp panels together so that the joint formed by the stitching is waterproof.

In a typical shoe construction the joint between the plug and vamp is not completely waterproof, since atmospheric water can seep through the interface formed by the stitching. Additional water can seep through the holes that hold the stitching thread.

The present invention contemplates a method of manufacturing shoes wherein the lower surface of the top plug and the mating surface of the vamp are pre-coated with a waterproofing material prior to the step of stitching the plug to the vamp. The stitching process pulls the coated surfaces together so that the merged coatings form an essentially continuous barrier to the seepage of water through the joint between the plug and vamp.

The action of the merged coatings is enhanced by placing the partially formed shoe in a drying oven. The waterproof coatings are typically formed of a tar-like material that tends to flow slightly when the partially-formed shoe is placed in a drying oven. The solvent carrier tends to vaporize, while the asphalt (tar) coating materials flow together, to eliminate any minute cracks or flow openings that might exist along the interface formed by the coatings.

To further enhance the waterproof action, an additional waterproof coating layer may be applied to the joint, on the interior surfaces of the plug and vamp panels. The additional waterproofing material provides insurance against water seepage through the joint between the plug and vamp.

Further features of the invention will be apparent from the attached drawings and description of a shoe construction formed by a manufacturing process that includes the method of the present invention.

In summary, and in accordance with the above discussion, the foregoing objectives are achieved in the following embodiments.

1. A method of forming a waterproof stitched connection between two shoe panels during a shoe manufacturing operation, comprising:

a) providing a coating of waterproofing material along one surface of a first panel that is to be stitched;

b) providing a coating of waterproof material along one surface of a second panel that is to be stitched;

c) bringing the coated surfaces of said panels together so that the two coating merge;

d) stitching through coated areas of said panels so that each stitch extends through the coated interface between the panels;

e) heating said panels to cause the interface coating to flow; and f) applying an additional coating of waterproofing material to the joint formed by the stitching, such that said additional coating merges with the previously applied coatings.

2. The method, as described in paragraph 1, wherein said one surface of each panel is an inside surface of the finished shoe.

3. The method, as described in paragraph 1, wherein said first panel is a top plug panel of the finished shoe, and said second panel is the vamp panel of the finished shoe.

4. The method, as described in paragraph 1, wherein step (d) is performed with said panels positioned on a shoe-forming last.

5. The method, as described in paragraph 4, wherein step (e) is performed by placing the shoe-forming last in a drying oven.

6. The method, as described in paragraph 5, wherein the partially-formed shoe is removed from the shoe-forming last between step (e) and step (f).

7. The method, as described in paragraph 5, wherein the partially-formed shoe is removed from the shoe-forming last after step (e); said method further comprising:

g) forming a slit in said second panel after step (e) to gain access to the joint formed by the stitching.

8. The method, as described in paragraph 5, and further comprising:

g) removing the partially-formed shoe from the shoe-forming last after step (e); and h) forming an access slit in said second panel after step (g) and before step (f).

9. The method, as described in paragraph 1, wherein said first panel is a top plug panel of the finished shoe, and said second panel is the vamp panel of the finished shoe; said stitching step (d) being performed on the toe areas of said plug and vamp panels.

10. A method of forming a waterproof stitched connection between a top plug panel and a vamp panel during a shoe manufacturing operation, comprising:

a) providing a coating of waterproofing material along the surface of the top plug panel that forms an inside surface of the finished shoe;

b) providing a coating of waterproofing material along the surface of the vamp panel that ultimately forms an inside surface of the finished shoe;

c) bringing the top plug panel and the vamp panel together on a shoe-forming last so that the coated surfaces form an interface between the two panels;

d) stitching through the coated areas of said plug and vamp panels so that each stitch extends through the coated interface;

e) placing the shoe-forming last in an oven to cause the waterproof coating materials to flow into intimate contact with the stitches;

f) removing the shoe-forming last from the oven;

g) removing the plug and vamp panels as a unit from the shoe-forming last;

h) forming an access slit in said vamp panel; and i) applying an additional coating of waterproofing material to the joint formed by the stitching.

11. The method, as described in paragraph 10, and further comprising:

j) reattaching the vamp panel areas that were previously severed by step (h); and k) applying a further coating of waterproofing material to the joint formed by step (j).

DESCRIPTION OF THE PREFERRED EMBODIMENTS OF THE PRESENT INVENTION

Figure 1:
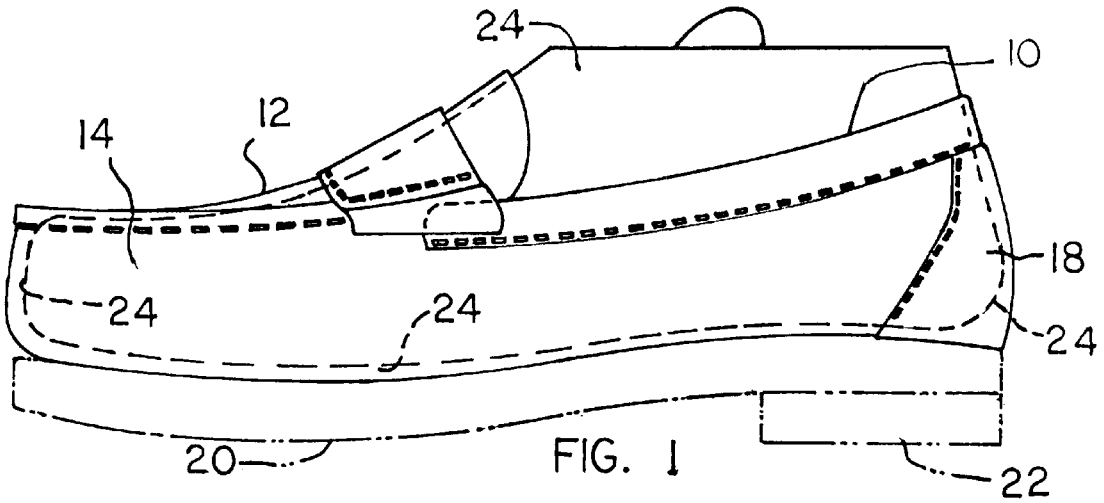
FIG. 1, is a side elevational view, of a partially-formed shoe manufactured by a procedure that includes the method of this invention. The partially-formed shoe is shown on a shoe-forming last of conventional construction.

FIG. 1, is a side elevational view, of a partially-formed shoe manufactured by a procedure that includes the method of this invention. The partially-formed shoe is shown on a shoe forming last of conventional construction.

Figure 2:
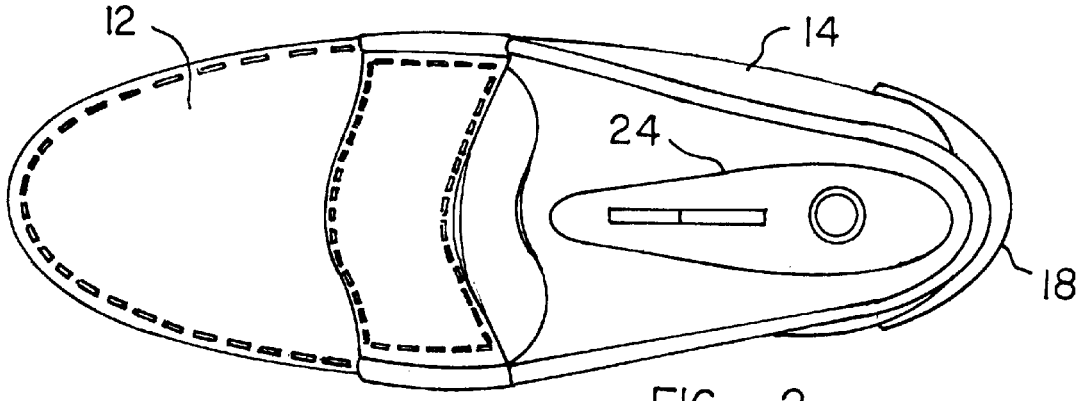
FIG. 2, is a top plan view, of the shoe-last assembly depicted in FIG. 1.

FIG. 2, is a top plan view, of the shoe-last assembly depicted in FIG. 1.

Figure 3:
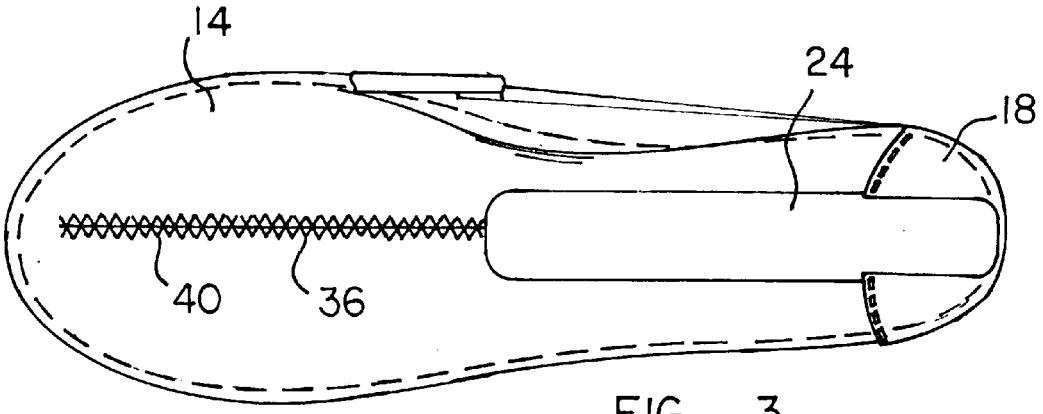
FIG. 3, is a bottom plan view, of the FIG. 1 shoe-last assembly.

FIG. 3, is a bottom plan view, of the FIG. 1 shoe last assembly.

Referring to FIGS. 1 through 3 of the drawings, there is shown a shoe upper 10 formed by a manufacturing process that includes a preferred method of the present invention. Shoe upper 10 includes a top plug panel 12 connected to a vamp panel 14 by a row of stitches 16 extending along the toe area and side edges of the shoe. The rear edges of the vamp are stitched together and then concealed by a heel panel 18.

FIG. 1, shows in phantom, a sole 20 and heel 22. The sole and heel do not form part of the present invention. The top plug 12 and vamp 14 are shown on a shoe-forming last 24 of conventional construction. Plug 12 is positioned on the upper front surface of last 24. Vamp 14 extends along the side and bottom surfaces of last 24.

Figure 4:
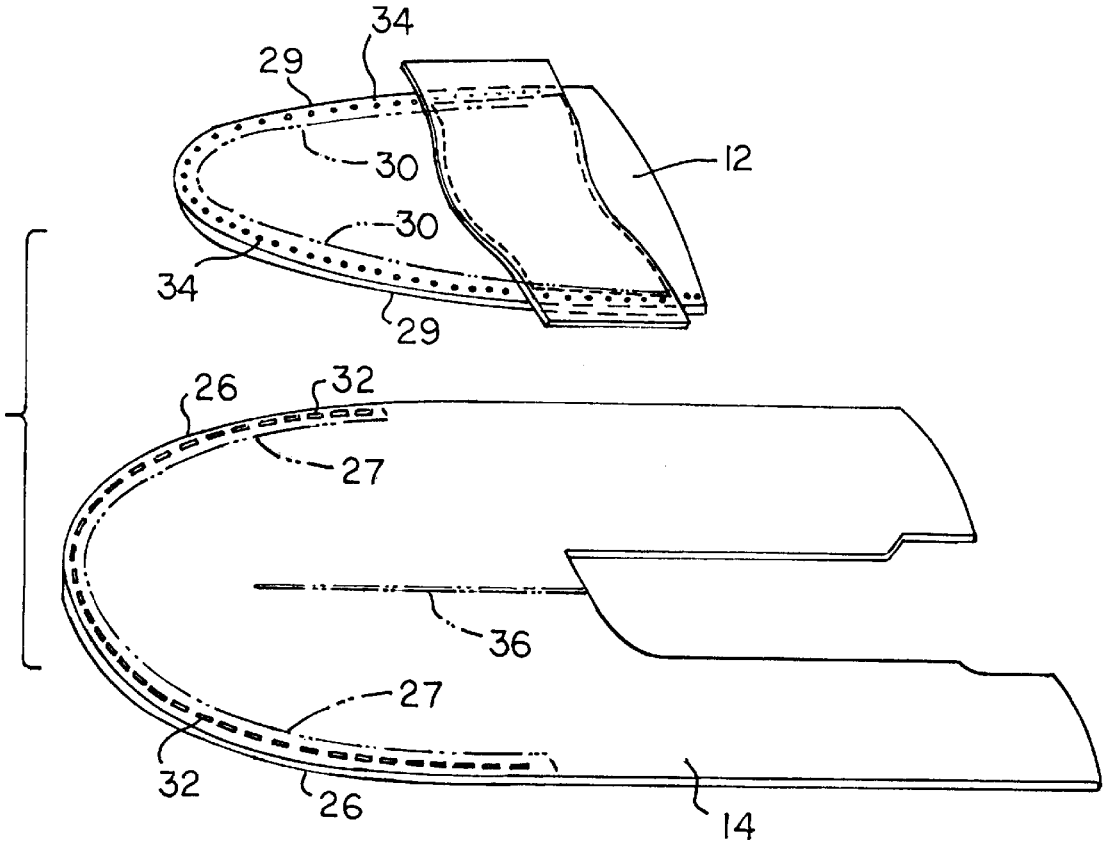
FIG. 4, is a perspective view, of a top plug and vamp prior to being stitched together, according to the invention.

FIG. 4, is a perspective view, of a top plug and vamp prior to being stitched together, according to the invention.

FIG. 4, shows plug 12 and vamp 14 in disconnected positions prior to placement on last 24. A first step in the method of this invention is to apply a coating of a conventional waterproofing material to the upper surface of vamp 14 and the under surface of plug 12, such that when the plug and vamp are later stitched together the waterproof coatings merge to form a continuous waterproof joint between the plug and vamp. The stitches hold the plug and vamp together, to maintain the continuous waterproof film.

In preferred practice of the invention, a primer is applied to the plug and vamp surfaces prior to application of the waterproof coatings. The primer can be a liquid material supplied by UPACO Adhesives Division of Worthen Industries, Inc., 3 East Spit Brook Road, Nashua, N.H. 03060, under its designation "1851". The waterproofing material can be a flowable asphalt-containing material supplied by the same company under its designation "1852 B". It is believed that other waterproofing materials can be used in practice of the invention.

The primer and waterproofing materials can be brushed onto the upper surface of vamp 14 and the undersurface of plug 12 along the toe areas thereof. Preferably the waterproofing extends in the form of a thin strip along the edge of the vamp or plug. In FIG. 4, the coating extends between edge 26 of vamp 14 and an imaginary line 27 spaced from edge 26 approximately one-half inch. A similar coating extends along the undersurface of plug 12 between edge 29 and an imaginary line 30 spaced from edge 29 approximately one-half inch. The width of each coating strip is sufficient to span the wall areas of plug 12 and vamp 14 that are pierced to accommodate stitches 16 (FIGS. 1 and 2).

After the vamp and plug have been brought together on the shoe-forming last 24, the vamp is stitched to the plug, to form the stitches 16. During the stitching process the surfaces coated with the tar-like waterproofing material are brought into pressure contact by the stitches, such that the two coatings merge together, to form a continuous barrier to the seepage of water across the joint.

Figure 5:
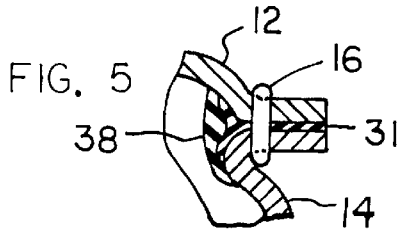
FIG. 5, is a fragmentary sectional view, taken through a waterproof joint formed by the method of the present invention.

FIG. 5, is a fragmentary sectional view, taken through a waterproof joint formed by the method of the present invention.

FIG. 5, shows the two waterproof coatings merged together to form a single film 31 between the mating surfaces of the vamp 14 and the plug 12. During the stitching process the stitching thread (or cord) is drawn through openings or slits in the vamp and plug walls. The thread openings can be pre-formed or formed by the awl that is used to pull the thread through the plug and vamp walls. In FIG. 4, the thread openings are designated by numerals 32 and 34.

To promote complete merger of the two waterproof coatings into an essentially continuous imperforate barrier film 31, the last 24 (with the partially formed shoe thereon) is placed in a dryer oven. The waterproofing materials flow to fill up any small cracks or voids in the coating materials. Also, solvent carrier for the asphalt material is driven off to improve the film density.

After removal of the last from the drying oven the vamp and connected plug are taken off the last, and a straight slit 36 is cut in the bottom surface of the vamp (see FIG. 3). This slit exposes the peripheral waterproofing film 31 to the space within vamp 14, such that an additional coating of waterproofing material can be applied along the inner edge of the waterproofed joint. FIG. 5 shows this additional coating 38 on the inner edge of barrier film 31. Coating 38 extends along the entire length of barrier film 31, i.e. the lengths of lines 27 and 30 in FIG. 4.

Slit 36 extends far enough toward the toe end of vamp 14 as to permit the vamp material to be pulled away to gain complete internal access to barrier film 31, for applying the additional internal coating 38 along the entire length of the stitched joint between vamp 14 and plug 12. As an alternative to slit 36, a fixture could be devised for spraying the waterproof coating along the interior edge of the stitched joint, without visually observing the joint.

After coating film 38 has been formed along the stitched joint the vamp areas separated by slit 36 are reattached. As shown in FIG. 3, stitching 40 can be used to reattach the severed areas of the vamp 14 bottom wall. Other reattachment mechanisms can be used, e.g. adhesive tape or stapling. Stitches 40 can be covered with a layer of waterproofing material, if desired for a better result.

The shoe upper 10 formed by the described method can be attached to the shoe sole 20 in conventional fashion. The present invention is concerned with the process of forming the stitched waterproof joint between the vamp and plug panels, as previously described.

The process involves the steps of providing waterproof coatings on the "interior" facing surfaces of plug 12 and vamp 14, stitching the plug and vamp together along stitch line 16 (FIG. 2), heating the vamp and plug in an oven to fully merge and densify the coating films along the stitched interface, and applying an additional coating 38 of waterproof material along the interior edge of the waterproof joint, as shown in FIG. 5. Some variations in procedure can be employed while still practicing the invention. Preferably the stitching operation is performed with the vamp and plug positioned on a last 24.

The present invention, described above, relates to a method of forming waterproof stitched connections during shoe manufacture. Features of the present invention are recited in the appended claims. The drawings contained herein necessarily depict structural features and embodiments of the method of forming waterproof stitched connections during shoe manufacture, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed:

1. A method of forming a waterproof stitched connection between two shoe panels during a shoe manufacturing operation, comprising:

a) providing a coating of waterproofing material along one surface of a first panel that is to be stitched;

b) providing a coating of waterproof material along one surface of a second panel that is to be stitched;

c) bringing the coated surfaces of said panels together so that the two coating merge;

d) stitching through coated areas of said panels so that each stitch extends through the coated interface between the panels;

e) heating said panels to cause the interface coating to flow; and f) applying an additional coating of waterproofing material to the joint formed by the stitching, such that said additional coating merges with the previously applied coatings.

2. The method, as described in claim 1, wherein said one surface of each panel is an inside surface of the finished shoe.

3. The method, as described in claim 1, wherein said first panel is a top plug panel of the finished shoe, and said second panel is the vamp panel of the finished shoe.

4. The method, as described in claim 1, wherein step (d) is performed with said panels positioned on a shoe-forming last.

5. The method, as described in claim 4, wherein step (e) is performed by placing the shoe-forming last in a drying oven.

6. The method, as described in claim 5, wherein the partially-formed shoe is removed from the shoe-forming last between step (e) and step (f).

7. The method, as described in claim 5, wherein the partially-formed shoe is removed from the shoe-forming last after step (e); said method further comprising:

g) forming a slit in said second panel after step (e) to gain access to the joint formed by the stitching.

8. The method, as described in claim 5, and further comprising:

g) removing the partially-formed shoe from the shoe-forming last after step (e); and h) forming an access slit in said second panel after step (g) and before step (f).

9. The method, as described in claim 1, wherein said first panel is a top plug panel of the finished shoe, and said second panel is the vamp panel of the finished shoe; said stitching step (d) being performed on the toe areas of said plug and vamp panels.

10. A method of forming a waterproof stitched connection between a top plug panel and a vamp panel during a shoe manufacturing operation, comprising:

a) providing a coating of waterproofing material along the surface of the top plug panel that forms an inside surface of the finished shoe;

b) providing a coating of waterproofing material along the surface of the vamp panel that ultimately forms an inside surface of the finished shoe;

c) bringing the top plug panel and the vamp panel together on a shoe-forming last so that the coated surfaces form an interface between the two panels;

d) stitching through the coated areas of said plug and vamp panels so that each stitch extends through the coated interface;

e) placing the shoe-forming last in an oven to cause the waterproof coating materials to flow into intimate contact with the stitches;

f) removing the shoe-forming last from the oven;

g) removing the plug and vamp panels as a unit from the shoe-forming last;

h) forming an access slit in said vamp panel; and i) applying an additional coating of waterproofing material to the joint formed by the stitching.

11. The method, as described in claim 10, and further comprising:

j) reattaching the vamp panel areas that were previously severed by step (h); and k) applying a further coating of waterproofing material to the joint formed by step (j).

* * * * *